US006305754B1

(12) United States Patent
Uehara et al.

(10) Patent No.: US 6,305,754 B1
(45) Date of Patent: Oct. 23, 2001

(54) TUNNEL EXCAVATOR WITH S-SHAPED SOIL PLATE

(75) Inventors: Toshiaki Uehara, Yachiyo; Takanobu Miki, Chita-gun; Tomofumi Ishino, Chita, all of (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 09/320,636

(22) Filed: May 26, 1999

(30) Foreign Application Priority Data

May 29, 1998 (JP) ..... 10-149340

(51) Int. Cl.[7] ..... E21D 9/08
(52) U.S. Cl. ..... 299/57; 299/59; 405/138
(58) Field of Search ..... 299/33, 59, 57, 299/58, 55, 56, 78; 405/138, 141, 142

(56) References Cited

U.S. PATENT DOCUMENTS 2,823,023 * 2/1958 Hlinsky ..... 299/57
2,862,700 * 12/1958 Gonski ..... 299/57
3,086,761 * 4/1963 McWhorter ..... 299/57
4,226,476 * 10/1980 Fairchild et al. ..... 299/33
4,915,453 * 4/1990 Fiske ..... 299/33
5,921,632 * 7/1999 LeBegue ..... 299/80.1

* cited by examiner

*Primary Examiner*—David Bagnell
*Assistant Examiner*—John Kreck
(74) *Attorney, Agent, or Firm*—McCormkick, Paulding & Huber LLP

(57) ABSTRACT

A tunnel excavator includes a pair of cutters arranged side by side at a front portion of a tunnel excavator main body. These cutters rotate in opposite directions for excavating the earth to form excavation and for causing the excavated earth to move toward a center area between the pair of cutters. The tunnel excavator further includes a screw cutter extending horizontally in a width direction of the tunnel excavator behind the pair of cutters at a lower level. The screw cutter has a pair of flights spiraling in opposite directions toward the center from opposite ends of the screw cutter for gathering the excavated earth to the center of the screw cutter. A soil plate generally extends along and behind the screw cutter and pushes the excavated earth as the tunnel excavator advances, but the soil plate has an outlet at a lower center area thereof for allowing the excavated earth to pass therethrough. A conveyor is provided behind the soil plate outlet.

10 Claims, 9 Drawing Sheets

TUNNEL EXCAVATOR WITH S-SHAPED SOIL PLATE

BACKGROUND OF THE INVENTION

1. Field of the Invention

The present invention relates to a tunnel excavator for tunneling into the ground, such as in coal mines, and more particularly to such a tunnel excavator which is improved in gathering of the excavated ground for disposal.

2. Description of the Related Art

One type of known tunnel excavators used in excavating ground such as in coal mines generally includes rotary cutters located at a front portion of the excavator for excavating the ground, and a chain or belt conveyor located behind the cutters for conveying the excavated ground toward the rear of the excavator (Japanese Patent Application, Laid-Open Publication (Kokai) No. 9-209693).

However, the conventional tunnel excavators can be improved with respect to their capability of gathering the excavated ground and conveying it to the rear of the excavator. Specifically, there is a need for an improved excavator which can gather and convey the excavated ground in a more efficient manner.

SUMMARY OF THE INVENTION

It is an object of the present invention to provide a tunnel excavator which can gather and convey the excavated ground in an effective way.

According to one aspect of the present invention, there is provided a tunnel excavator including a pair of horizontally and laterally spaced rotary cutters adapted to rotate in opposite directions for excavating the ground and gathering the excavated ground toward a center area between the rotary cutters, a screw cutter extending generally along and behind the rotary cutters at a lower level and having a plurality of flights spirally arranged in opposite directions toward the center from ends of the screw cutter for gathering the excavated ground or soil toward the center of the screw cutter, a soil plate located behind the screw cutter generally along the screw cutter for pushing the soil as the excavator advances, and an opening formed in the soil plate at a lower center area thereof.

The ground excavated by the oppositely rotating cutters is gathered to a lower front center of the tunnel excavator by the opposite rotations of the cutters. The soil is also gathered to the lower front center of the excavator by the oppositely spiraling flights of the screw cutter. The soil is then pushed by the following soil plate upon advancement of the excavator, but the soil plate has the opening (soil outlet) at its lower center so that the soil is allowed to escape rearward through this opening. A conveyor extending to the rear of the excavator may be provided after the soil outlet to convey the soil rearward.

Since the excavated ground is gathered to the lower front center of the excavator by the rotary cutters and screw cutter and then conveyed to the conveyor through the soil plate opening, gathering and conveying of the excavated ground are performed efficiently.

The soil plate may have an "S" cross section to cover upper and side portions of the screw cutter. Such soil plate will perform as a casing for the screw cutter so that the screw cutter can also perform as an improved screw conveyor. Specifically, capability of the screw cutter as the screw conveyor will be enhanced and therefore efficient gathering of the excavated ground will be realized.

A rotatable soil paddle may be provided above the screw cutter for guiding (or promoting movements of) the soil to the soil plate opening. The soil paddle rotates to convey the soil to the soil plate opening in cooperation with the rotating screw cutter. Accordingly, the soil is gathered and conveyed to the conveyor in an efficient manner.

DETAILED DESCRIPTION OF THE INVENTION

Now, embodiments of the present invention will be described in reference to the accompanying drawings.

Figure 1:
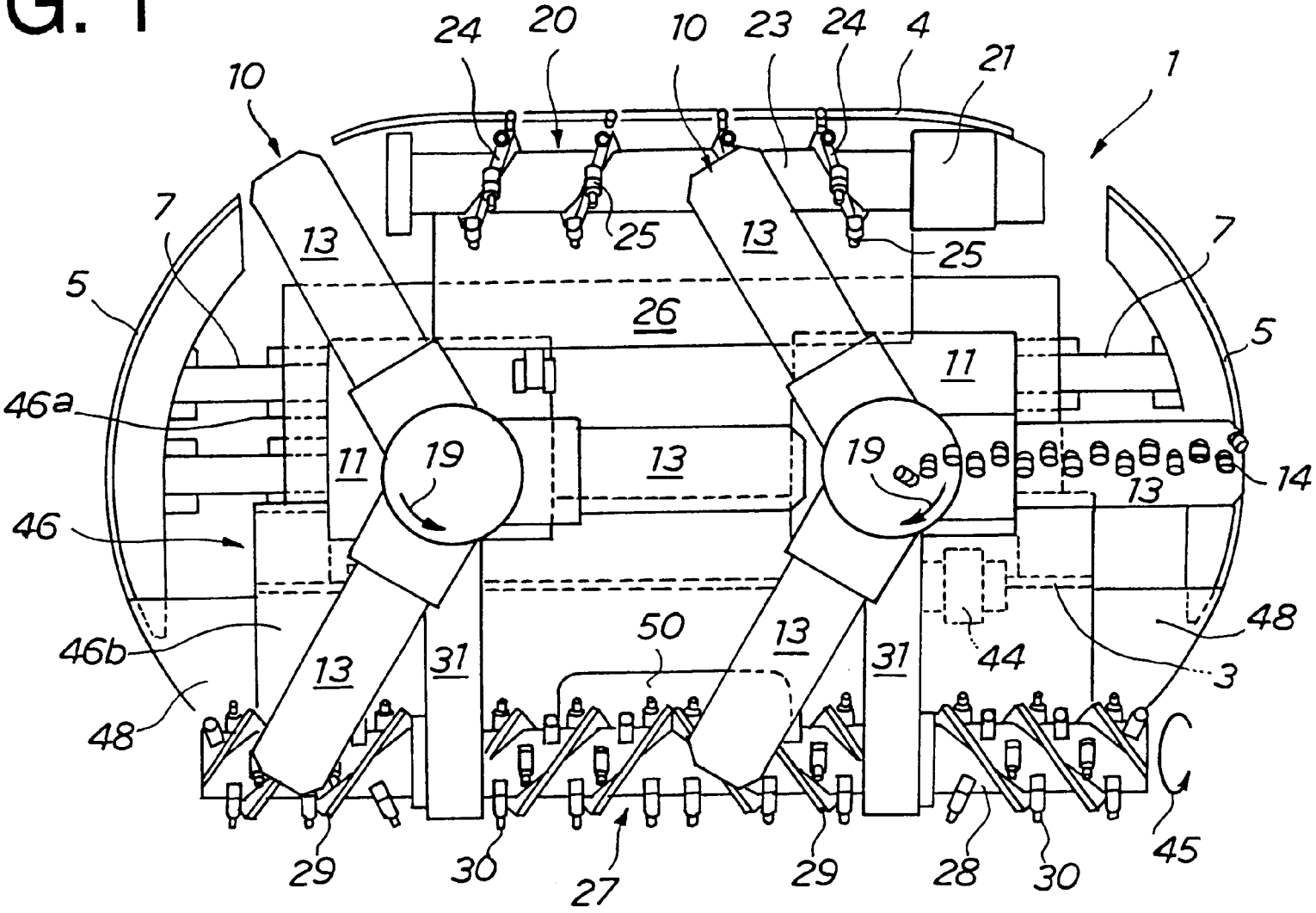
FIG. 1 is a front view of a tunnel excavator according to an embodiment of the present invention.
Figure 2:
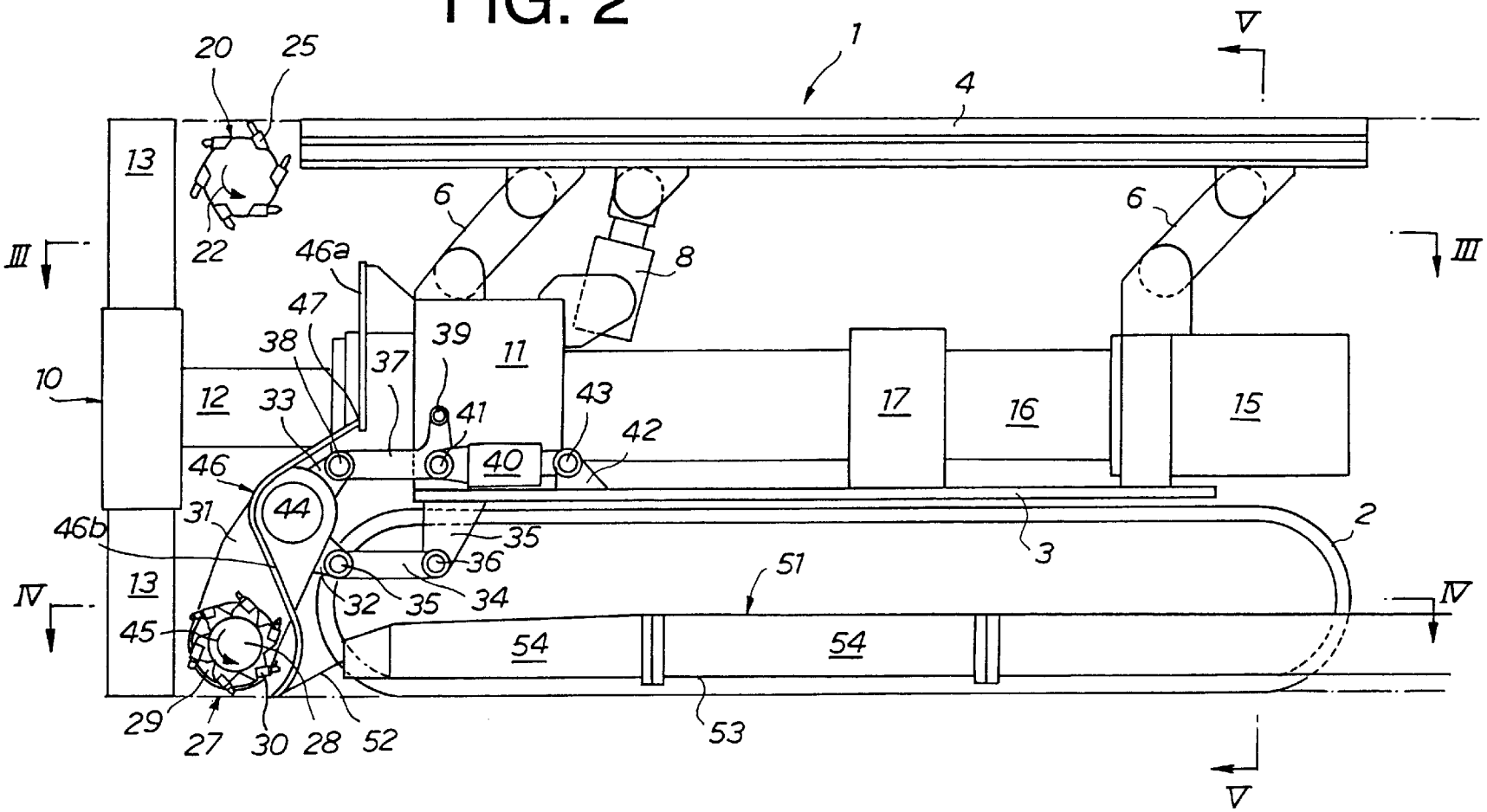
FIG. 2 is a side sectional view of the tunnel excavator shown in FIG. 1.
Figure 3:
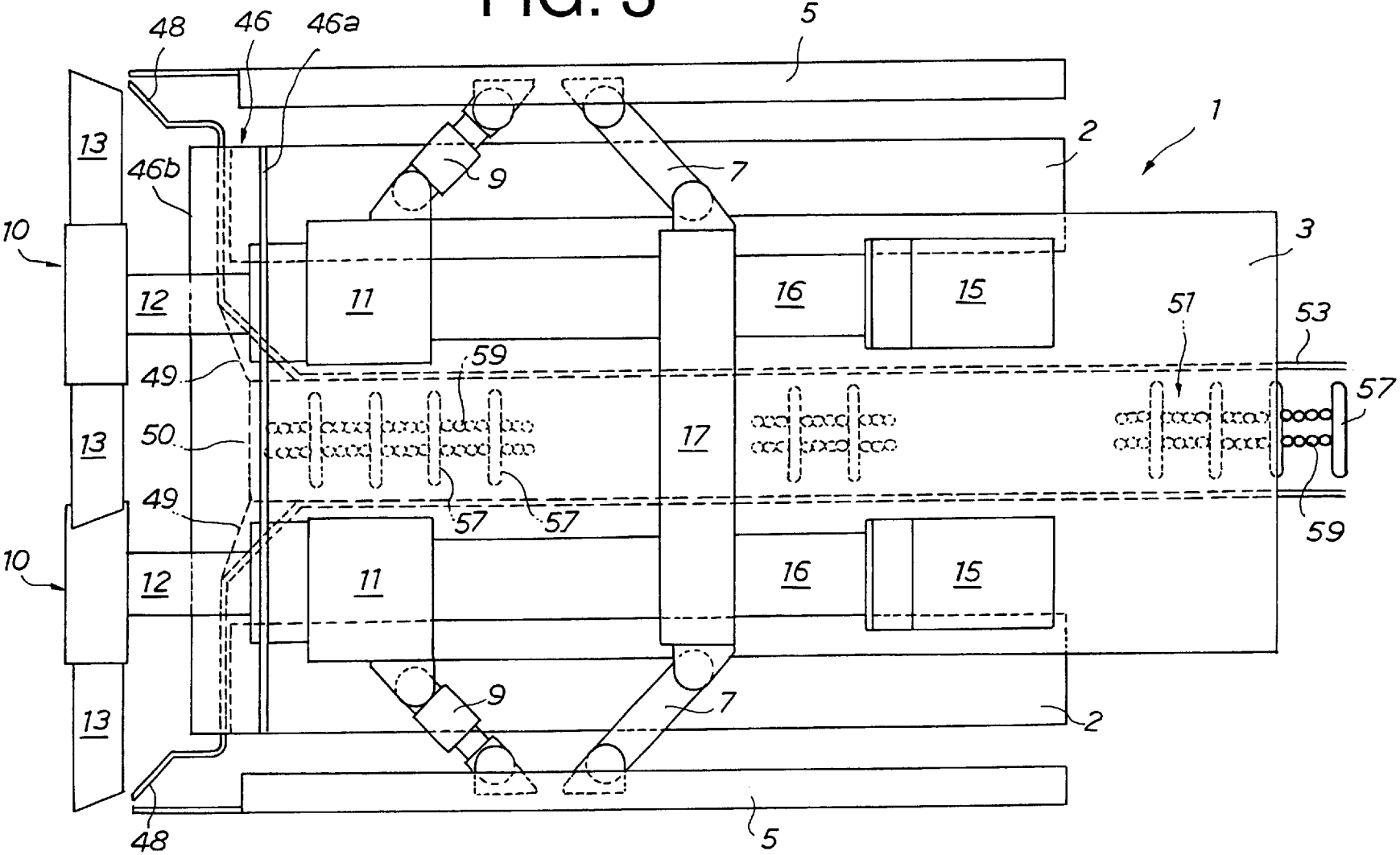
FIG. 3 is a cross sectional view taken along the line III—III in FIG. 2.

First Embodiment:

Referring to FIGS. 1 through 3, a tunnel excavator 1 is adapted to tunnel into earth mixed with coal in a coal mine. This tunnel excavator 1 includes a cutter supporting body 3 equipped with a pair of (right and left) crawlers 2 for forward and backward movements. The cutter supporting body 3 also has an upper bearing frame 4 which is movable upward until it contacts a roof of a tunnel and side bearing frames 5 which are movable to the right and left until they contact ribs of the tunnel. The upper and side bearing frames 4 and 5 are moved by associated link mechanisms 6 and 7 (e.g., parallel links) and jacks 8 and 9 (e.g., electric or hydraulic jacks). The upper bearing frame 4 is generally planar and the side bearing frames 5 are generally arcuate conforming with rotation orbits of the respective cutters 10.

Two rotary cutters 10 are mounted in a horizontal row and separated by a prescribed distance on the cutter supporting body 3, and the ground is excavated by these cutters 10. Each of the rotary cutters 10 includes a rotating shaft 12 which is rotatably supported by a support block 11 established on the cutter supporting body 3, three cutter spokes 13 radiantly mounted at prescribed intervals around the circumference of the front end of the rotating shaft 12, and cutting picks 14 mounted on each cutter spoke 13 for essentially excavating the earth. The six cutter spokes 13 on the two cutters 10 are disposed so as to intermesh in a single plane without interfering with each other. It should be noted that the number of the cutter spokes 13 on each cutter 10 is not restricted to three and may be two, four, or more. It should also be noted that the circumferential intervals between the cutter spokes 13 may not be even.

Figure 5:
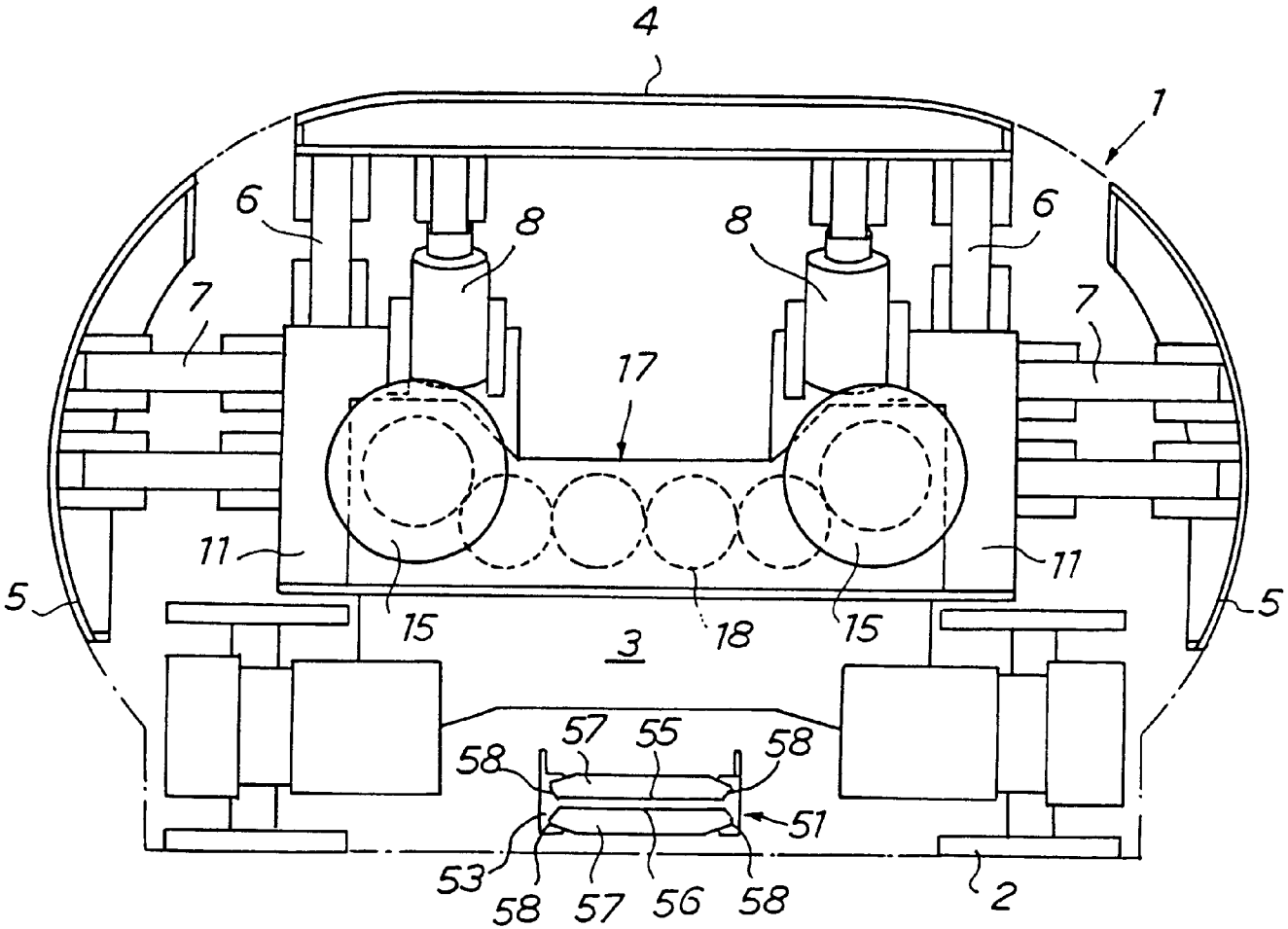
FIG. 5 is a cross sectional view taken along the line V—V in FIG. 2.
Figure 6:
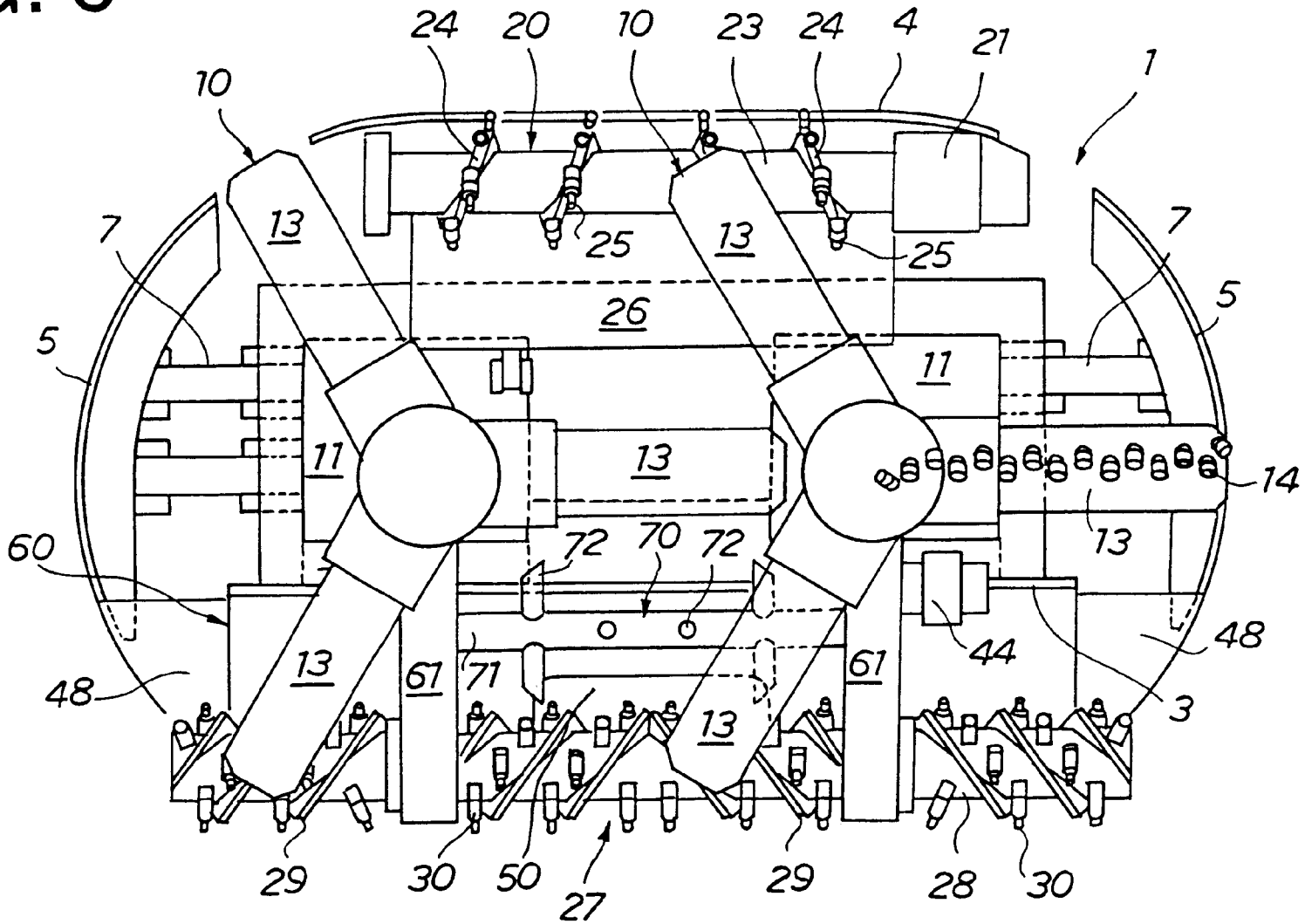
FIG. 6 is a front view of a tunnel excavator according to another embodiment of the invention.

The rotating shaft 12 of each rotary cutter 10 is operatively connected by means of a synchronization gear box 17 to a drive shaft 16 of an associated drive motor 15 (electric or hydraulic motor) mounted on the cutter supporting body 3. As illustrated in FIG. 5, the synchronization gear box 17 contains a gear train 18, and holds the two rotating shafts 12 of the cutters 10 in the desired phases respectively while rotating them in opposite directions at the same speed. The gear box 17 therefore prevents interference (collisions) among the inter-meshing cutter spokes 13. As indicated by the arrows 19 in FIG. 1, the cutters rotate in opposite directions such that the spoil is gathered to the center.

As illustrated in FIGS. 1 and 2, a sub-cutter 20 is disposed generally horizontally at an upper level behind the rotary cutters 10. The sub-cutter 20 includes a cylindrical member 23 which is rotated by a motor 21 as indicated by the arrow 22 (FIG. 2), two flights 24 which are provided on the surface of the cylindrical member and which spiral in opposite directions toward the center from each end of the rotary member 23, and a plurality of cutter bits 25 attached to the flights 24. The sub-cutter 20 has a purpose of excavating upper areas out of range of the rotating cutters 10 and which cannot be excavated by the cutters 10. In short, the sub-cutter 20 performs as a trimming cutter. This sub-cutter 20 also pulls or gathers the spoil from the ends toward the center as it rotates. Specifically, the oppositely spiraling flights 24 convey the excavated earth toward the center upon rotations of the sub-cutter 20.

The sub-cutter 20 is supported from the support blocks 11 of the cutter supporting body 3 by means of a link mechanism (not shown). The sub-cutter 20 is caused to move upwards and downwards within a prescribed range upon extension and contraction of the link mechanism by associated jacks (not shown). Below the sub-cutter 20, provided is a soil deflector 26 (FIG. 1) for guiding the soil (earth excavated by the sub-cutter 20) downwards and preventing the soil from going backwards. The soil deflector 26 is a plate member mounted on the above-mentioned link mechanism so that it is tilted upon up and down movements of the sub-cutter 20.

Figure 4:
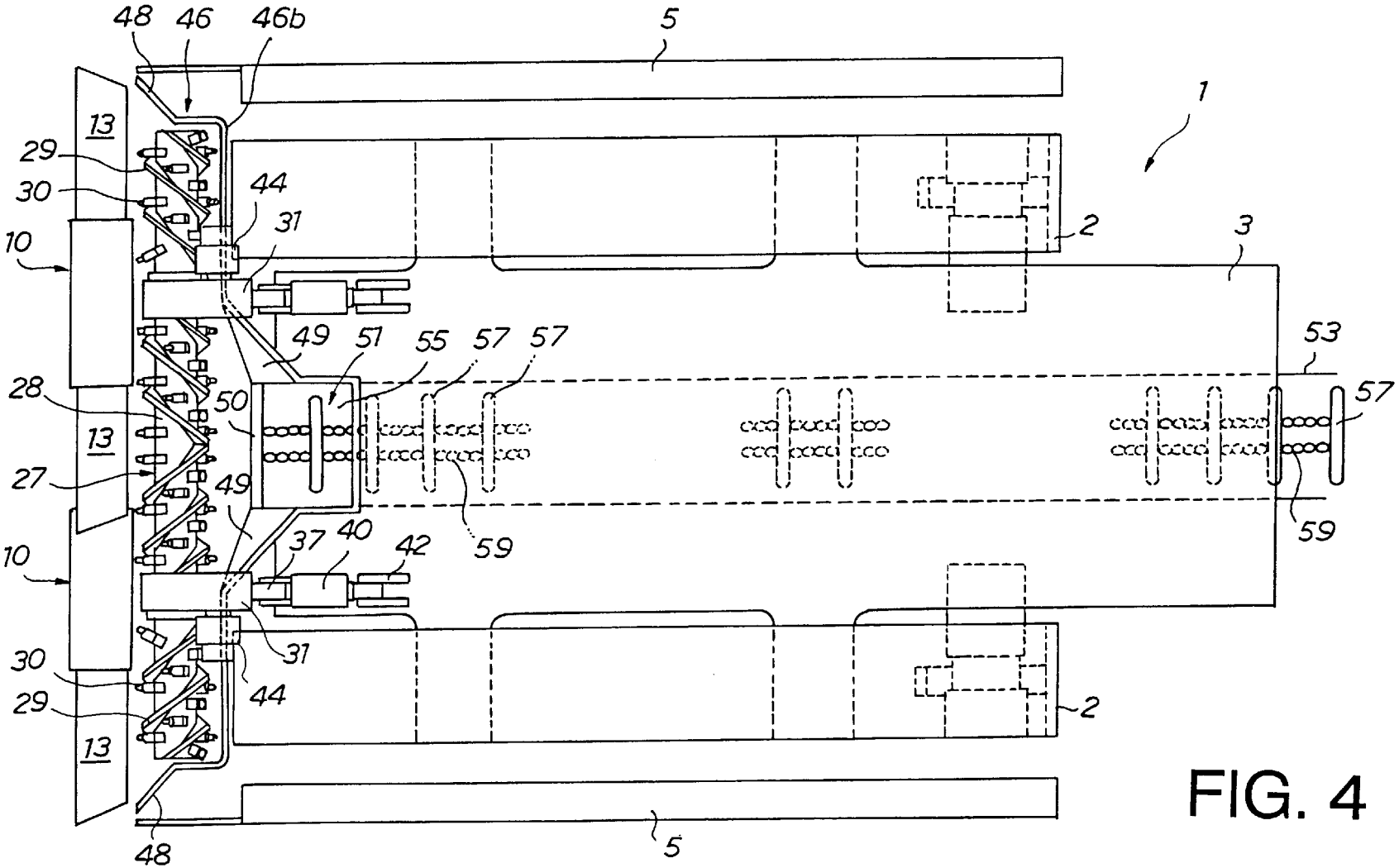
FIG. 4 is a cross sectional view taken along the line IV—IV in FIG. 2.

A screw cutter 27 is also horizontally arranged behind the rotary cutters 10 at a lower level as illustrated in FIGS. 1, 2 and 4. As best seen in FIG. 4, the screw cutter 27 includes a cylindrical member 28 extending slightly longer than the span between the right and left crawlers 2, a pair of flights 29 provided on the surface of the cylindrical member 28 and oppositely spiraling toward the center from the ends of the cylindrical member 2, and two groups of cutter picks 30 also spirally arranged on the surface of the cylindrical member 28 in opposite directions to the center from the ends of the cylindrical member 2 along the flights 29. The screw cutter 27 performs as a trimming cutter since its cutter picks 30 excavate lower areas out of range of the rotating cutters 10. In general, such areas cannot be excavated by the cutters 10. The screw cutter 27 also performs as a screw conveyor since its flights 29 gather the spoil from the ends toward the center upon rotations of the screw cutter 27.

As illustrated in FIGS. 1 and 2, the cylindrical member 28 of the screw cutter 27 is rotatably supported by lower end portions of two arms 31. These arms 31 are spaced in the width direction of the tunnel. As best seen in FIG. 2, each of the arm members 31 has a center bracket 32 and an upper bracket 33. One end of an elongated link plate 34 is operatively connected to the center bracket 32 by means of a pin 35, and the other end is operatively connected to a bracket 35 on the cutter supporting body 3 by a pin 36.

One end of an L-shaped link plate 37 is operatively connected to the upper bracket 33 by a pin 38, and the other end is pivotably connected to the support block 11 on the cutter supporting body 3 by a pin 39. To the corner of the L-shaped link plate 37, connected by a pin 41 is one end of a jack (electric or hydraulic jack) 40. The opposite end of the jack 40 is connected to a bracket 42 on the cutter supporting body 3 by means of a pin 43. Accordingly, the screw cutter 27 is supported from the cutter supporting body 3 via the link plates 34 and 37 and is caused to move up and down as the jack 40 expands and shrinks.

As also depicted in FIG. 4, a drive motor (electric or hydraulic motor) 44 is mounted on an upper side face of each arm member 31 for rotating the cylindrical member 28 of the screw cutter 27. A rotary force from each drive motor 44 is transmitted to the cylindrical member 28 through a gear train (not shown) housed in the associated arm member 31. The screw cutter 27 is therefore caused to rotate in a direction as indicated by the arrow 45 in FIG. 2 so as to roll in the excavated ground below itself. It should be noted that an endless chain may be provided in each arm member 31 instead of the gear train to transfer the rotating power of the associated drive motor 44 to the screw cutter 27.

Behind the screw cutter 27, provided is a soil plate 46 for pushing the soil forward as the cutter supporting body 3 advances. The soil plate 46 generally extends along the screw cutter 27 if viewed from the top. As illustrated in FIG. 2, the soil plate 46 includes an upper plate **46*a* mounted on the support blocks 11 and a lower plate 46*b* mounted on the arm members 31. The upper and lower plates 46*a* and 46*b* are separated at a contact 47 such that the lower plate 46*b* swings upon swinging movements of the arm members 31 which are caused by extension and retraction of the jacks 40. The upper plate 46*a* is planar (linear in cross section) and the lower plate 46*b* has an "S" cross section covering an upper rear portion of the screw cutter 27**.

Specifically, the lower half of the lower plate **46*b* extends behind the screw cutter 27 at a certain clearance to cover an approximate (upper) rear quarter of the screw cutter 27. In other words, the lower half of the lower plate 46*b* is configured like a 180-degree turned C-shaped casing for the screw cutter 27 behind the screw cutter 27. The upper half of the lower plate 46*b* is configured like "C" extending over part of the top of the screw cutter 27. Accordingly, the lower plate 46*b* extends like "S" as a whole in FIG. 2. As depicted in FIG. 4, the lower plate 46*b* has tapered edges 48 at its right and left ends respectively to direct (or facilitate movements of) the soil toward the center. The lower plate 46*b* also has another tapered portions 49 near the center thereof to guide (or promote the movements of) the soil into its center opening 50. The center opening 50 opens behind the center area of the screw cutter 27 as best illustrated in FIG. 1. This opening 50 is formed, for example, by cutting a lower center portion of the soil plate 46 from a lower side of the soil plate 46**.

The opening 50 of the soil plate 46 is a lower rectangular cutout which opens to a chain conveyor 51 adapted to further convey the soil to the rear of the excavator 1. In other words, the soil plate opening 50 is a soil outlet to pass the soil to the chain conveyor 51. As illustrated in FIG. 2, a slope 52 is also provided between the soil outlet 50 and the chain conveyor 51 to guide the soil to the chain conveyor 51 from the soil outlet 50 as the excavator 1 advances. As illustrated in FIGS. 2 through 5, the chain conveyor 51 has a conduit or channel element 53 extending towards the rear of the tunnel. The conduit element 53 includes a plurality of segments 54 connected in series as shown in FIG. 2, defining a soil passage extending to the rear. It should be noted that additional conduit segments 54 may be attached as required. It should also be noted that the length of conduit member 53 may be fixed and the soil may further be conveyed to the rear (entrance of the tunnel) by another belt conveyor or truck (neither shown) from the downstream end of the conduit member 53.

Referring to FIG. 5, the upper surface of the conduit element 53 forms a carrier surface 55 and the lower surface forms a return surface 56. Depressed portions 58 to anchor paddles 57 are formed in both sides of the surfaces 55 and 56. As illustrated in FIGS. 3 and 4, a plurality of paddles 57 is disposed on the carrier surface 55 and return surface 56 at prescribed intervals lengthwise to the conduit element 53. A pair of parallel endless chains 59 connect these paddles 57. With this constitution, the excavated ground conveyed onto the conveyor 51 from the soil outlet 50 is transported to the rear by the paddles 57 on the carrier surface 55 upon the circulation of the endless chains 59 with an associated driving means (not shown).

Now, an operation of the tunnel excavator 1 will be described.

A pair of crawlers 3 is activated to advance against the ground when the tunnel excavator 1 excavates the ground, with the upper and side bearing frames 4 and 5 being in contact with the roof and ribs of the tunnel and the rotary cutters 10, sub-cutter 20 and screw cutter 27 being driven. The chain conveyor 51 is also activated at the same time. Most of the ground in front of the excavator 1 is excavated by the oppositely rotating cutters 10, and the remaining ground is excavated by the cutter picks 25 and 30 of the sub-cutter 20 and screw cutter 27. The excavated ground falls along the soil plates 26 and 46.

During descending, the soil is conveyed by the side faces of the cutter spokes 13 of the cutters 10 toward the lower center area between the two cutters 10. The soil on or near the tunnel floor is also gathered to the center by the oppositely spiraling flights 29 of the following screw cutter 27. The soil is then pushed forward by the following soil plate 46 as the cutter supporting body 3 advances and the center opening 50 of the soil plate 46 allows the soil to be passed to the chain conveyor 51. Therefore, gathering or scarpering the soil to the lower center area and transferring it to the chain conveyor are performed in an effective manner.

Since the soil plate 46 has an "S" cross section to cover the upper and rear portions of the screw cutter 27 in the illustrated embodiment (FIG. 2), it can not only push the excavated earth but also house the screw cutter 27 thereby allowing the screw cutter 27 to function as an improved screw conveyor. Capability of the screw cutter 27 as the screw conveyor is enhanced by the soil plate 46. Therefore, it is made possible to efficiently gather the soil to the center (or the soil plate opening 50). Specifically, in FIG. 2, the soil is first rolled up by the screw cutter 27 along the soil plate 46 upon rotations of the screw cutter 27, but it is forced down by the "S"-shaped soil plate 46 extending over the screw cuter 27 as it hits the soil plate 46. As a result, the soil is effectively conveyed to the center of the screw conveyor 27 by the flights 29 of the screw conveyor 27. The soil plate 46 is spaced from the screw cutter 27 and configured such that it can function as an appropriate casing of the screw cutter (screw conveyor) 27.

Second Embodiment:

A second embodiment according to the present invention will now be described in reference to FIGS. 6 through 9.

The fundamental construction and operation of a tunnel excavator according to this embodiment are the same as the first embodiment, and the second embodiment is similar to the first embodiment in many aspects. Therefore, similar components are allotted similar reference numerals and referred to as similar names, and their description will be omitted below; differences will only be described.

Figure 7:
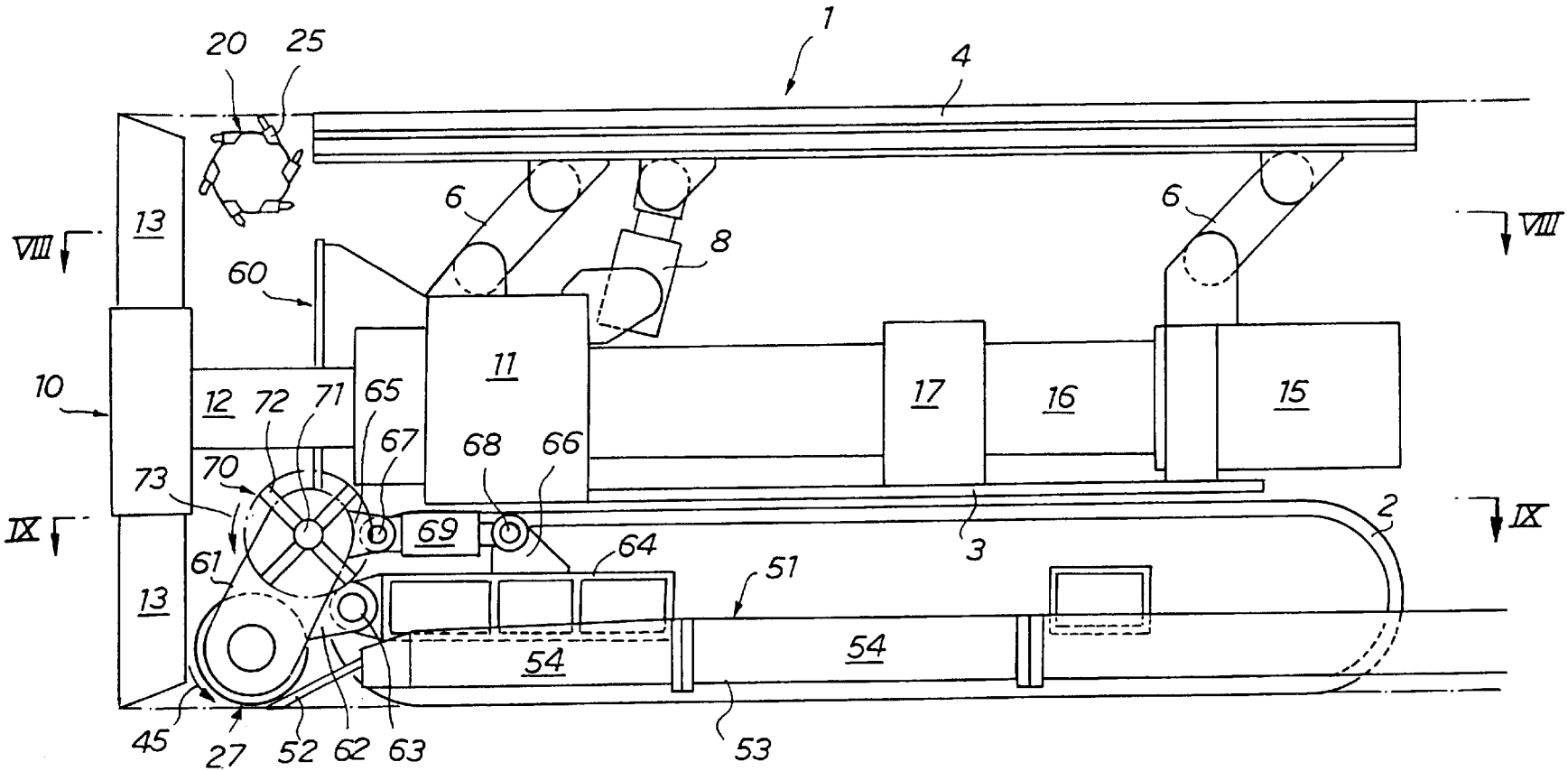
FIG. 7 is a side cross sectional view of the tunnel a excavator shown in FIG. 6.
Figure 8:
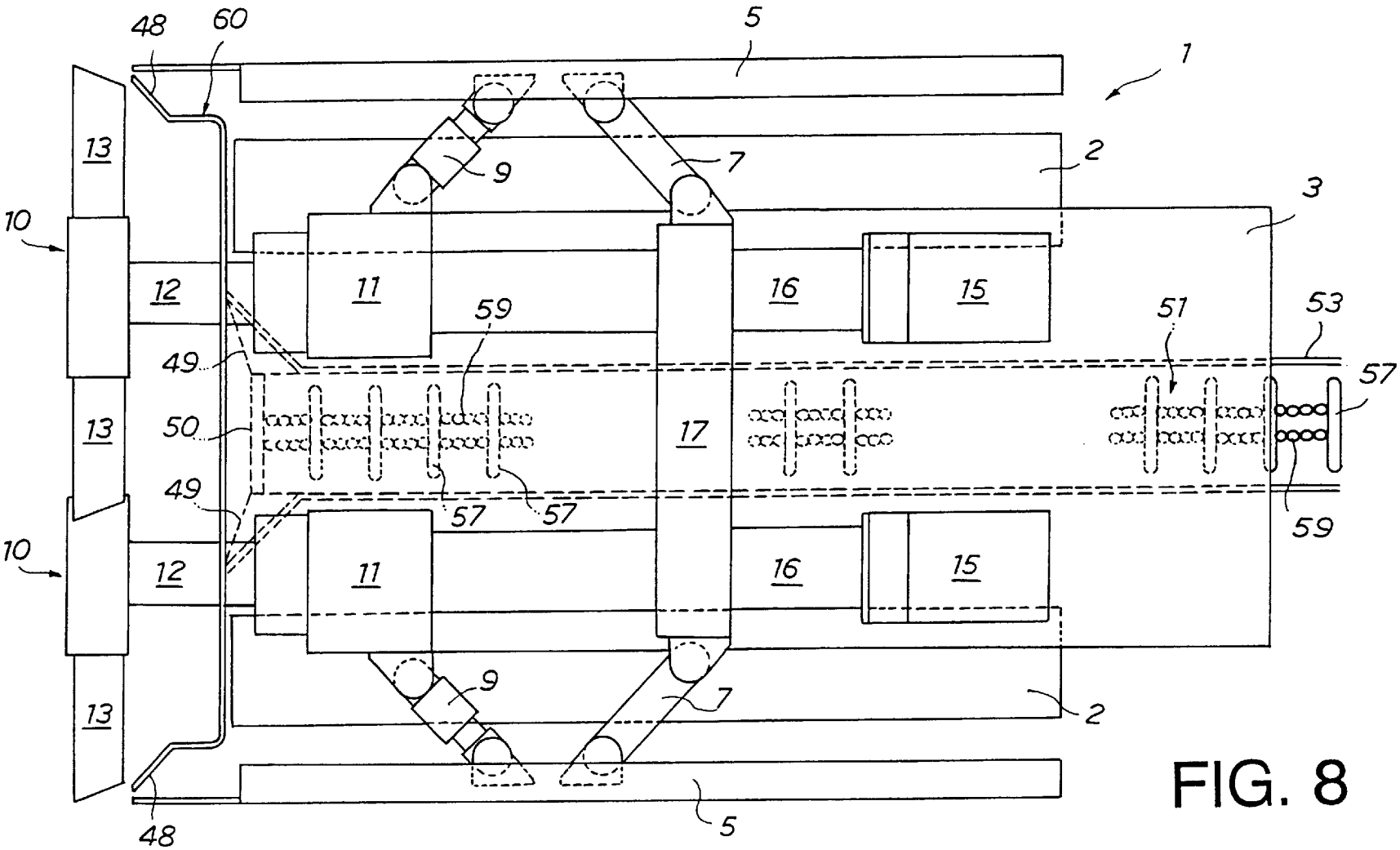
FIG. 8 is a cross sectional view of FIG. 7 as taken along the line VIII—VIII.
Figure 9:
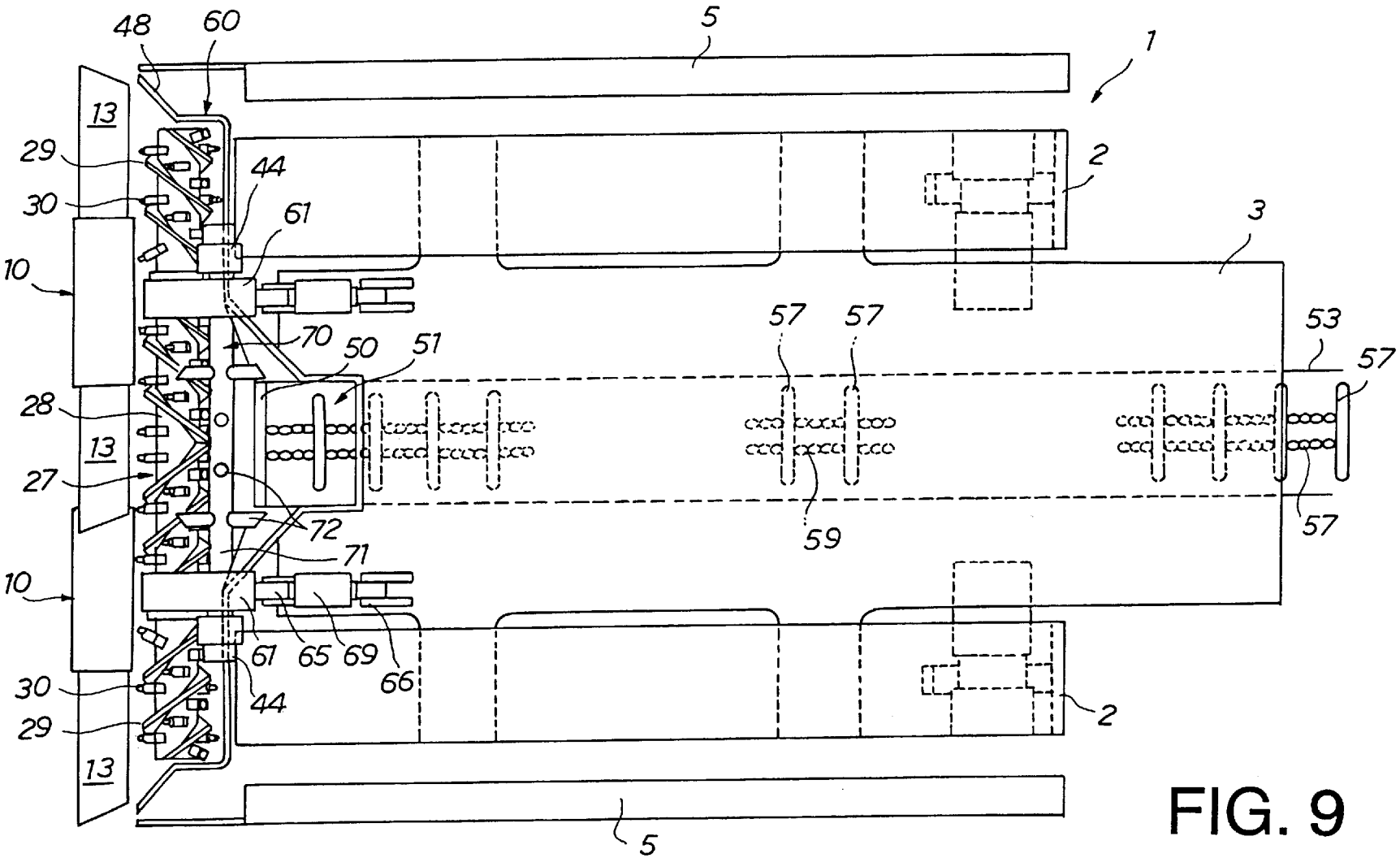
FIG. 9 is a cross sectional view of FIG. 7 as taken along the line IX—IX.

As illustrated in FIGS. 7 and 8, the soil plate 60 (corresponds to the plate 46 in FIG. 2) is a planar member in this embodiment, not "S" in cross section. This soil plate 60 is vertically mounted on the cutter supporting body 3. In FIG. 7, each of the arm members 61 has a center bracket 62 and operatively connected to a block 64 on the cutter supporting body 3 at the center bracket 62 by means of a pin 63. Each arm member 61 is therefore pivotable about the associated pin 63. Between the upper portion of each arm member 61 and the block 64, interposed is a jack (electric or hydraulic jack) 69 with brackets 65 and 66 and pins 67 and 68.

A soil gathering paddle 70 is rotatably supported between the right and left arms 61 above the screw cutter 27 for guiding the soil to the soil outlet 50. The soil paddle 70 includes a rotatable shaft 71 supported between the arms 61 and a plurality of relatively short rods 72 radially extending from the shaft 71. These rods 72 are spaced in the longitudinal direction of the shaft 71 at predetermined intervals and in the circumferential direction at 180° intervals. It should be noted that the rods 72 may be provided at 120° or less intervals in the circumferential direction of the shaft 71.

The soil paddle 70 is caused to rotate together with the rods 72 in the same direction as the screw cutter 27 as indicated by the arrow 73 by a drive motor 44 which is also used to drive the screw cutter 27. In this embodiment, the rotating soil paddle 70 guides the soil into the soil outlet 50 in cooperation with the rotating screw cutter 27. Consequently, the soil is efficiently conveyed to the soil outlet 50. The soil paddle 70 has a planar shape in the illustrated embodiment in order to arrange the soil paddle 70 above the screw cutter 27.

This application claims the priority rights of Japanese Patent Application No. 10-149340 filed May 29, 1998 and the entire disclosure of this Japanese Application is incorporated herein by reference.

What is claimed is:

1. A tunnel excavator comprising:

a pair of cutters arranged side by side at a front portion of the tunnel excavator and adapted to rotate in opposite directions for excavating the earth to form excavation and gathering the excavated earth toward a center area between the pair of cutters;

a cutter supporting body for supporting the pair of cutters;

a screw cutter extending horizontally behind the pair of cutters at a lower level and having a pair of flights spiraling in opposite directions toward the center from opposite ends of the screw cutter for gathering the excavated earth to the center of the screw cutter;

a soil plate attached to arm members swingably supported from the cutter supporting body, which soil plate extends generally along and behind the screw cutter for pushing the excavated earth as the tunnel excavator advances; and a soil outlet formed in the soil plate for allowing the excavated earth to pass therethrough;

the soil plate having an "S" cross section to cover an upper portion of the screw cutter and also having tapered portions to facilitate movements of the excavated earth toward the soil outlet, an approximate lower half of the soil plate covering an approximate upper rear quarter of the screw cutter.

2. The tunnel excavator of claim 1, wherein the soil plate is attached to arm members swingably supported from the cutter supporting body.

3. The tunnel excavator of claim 1, wherein the soil plate has tapered portions to facilitate movements of the excavated earth toward the soil outlet.

4. The tunnel excavator of claim 1 further including a pair of crawlers for forward and backward movements of the tunnel excavator, the pair of crawlers being spaced in a width direction of the tunnel excavator, and wherein the screw cutter extends longer than the space between the pair of crawlers.

5. The tunnel excavator of claim 4, wherein the screw cutter is mounted on arms swingably supported from the cutter supporting body.

6. The tunnel excavator of claim 1, wherein the screw cutter is mounted on arms swingably supported from the cutter supporting body.

7. The tunnel excavator of claim 1, wherein the screw cutter and soil plate are both mounted on arms swingably supported from the cutter supporting body.

8. The tunnel excavator of claim 1 further including a conveyor located behind the soil outlet for conveying the excavated earth, which has passed the soil outlet, to the rear of the tunnel excavator.

9. The tunnel excavator of claim 1 further including an upper bearing frame extendible from the cutter supporting body until it contacts a roof of the excavation, and side bearing frames extendible from the cutter supporting body until they contact ribs of the excavation respectively.

10. The tunnel excavator of claim 1 further including a sub-cutter provided on the cutter supporting body for excavating the earth which the pair of cutters cannot excavate.

* * * * *